US012507778B2

(12) United States Patent
Meersschaert

(10) Patent No.: US 12,507,778 B2
(45) Date of Patent: Dec. 30, 2025

(54) ZIPPER ASSEMBLY LOOP END ATTACHMENT FOR A LUGGAGE CASE

(71) Applicant: Samsonite IP Holdings S.a r.l., Luxembourg (LU)

(72) Inventor: Reinhard Meersschaert, Merelbeke (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 121 days.

(21) Appl. No.: 18/378,700

(22) Filed: Oct. 11, 2023

(65) Prior Publication Data

US 2024/0115023 A1 Apr. 11, 2024

(30) Foreign Application Priority Data

Oct. 11, 2022 (EP) ..... 22200909

(51) Int. Cl.
*A45C 13/10* (2006.01)
*A45C 5/03* (2006.01)
*A45C 7/00* (2006.01)

(52) U.S. Cl.
CPC ..... *A45C 13/103* (2013.01); *A45C 5/03* (2013.01); *A45C 7/0027* (2013.01)

(58) Field of Classification Search
CPC ..... A45C 13/103; A45C 5/03; A45C 7/0027
See application file for complete search history.

(56) References Cited

U.S. PATENT DOCUMENTS 2,928,155 A * 3/1960 Kallio ..... A44B 19/00 24/389
3,158,238 A * 11/1964 Kish, Jr. ..... A45C 5/02 206/315.9

(Continued)

FOREIGN PATENT DOCUMENTS

EP 4353119 A1 4/2024
EP 4353120 A1 4/2024

(Continued)

OTHER PUBLICATIONS

Extended European Search Report for European Patent Application No. 23199053.2 dated Dec. 11, 2023, 7 pages.

(Continued)

*Primary Examiner* — Tri M Mai
(74) *Attorney, Agent, or Firm* — Dorsey & Whitney LLP

(57) ABSTRACT

A luggage case including a zipper loop mounted thereon, the luggage case including a first zip member having an elongated first tape member with first zipper teeth extending along an edge, the first zip member having first and second opposing ends, the first zip member attached along a first rim portion of a first shell; a second zip member having an elongated second tape member with second zipper teeth extending along an edge, the second zip member having third and fourth opposing ends, the second zip member attached along a second rim portion of a second shell, and wherein the first zip member and the second zip member include substantially the same number of zipper teeth; the first zip member and the second zip member are attached together by engaging the first and second zipper teeth, with the first opposing end laterally adjacent the third opposing end, and the second opposing end laterally adjacent the fourth opposing end; the first opposing end attached to the second opposing end by a first joining member; and the third (Continued)

opposing end attached to the fourth opposing end by a second joining member.

14 Claims, 11 Drawing Sheets

(56) References Cited

U.S. PATENT DOCUMENTS

| | | | | |
|---|---|---|---|---|
| 3,443,671 | A * | 5/1969 | Dyke | A45C 7/0027 383/61.3 |
| 9,204,696 | B2 | 12/2015 | Tseng et al. | |
| 9,986,846 | B1 * | 6/2018 | Davis | A47C 31/105 |
| 2011/0005042 | A1 | 1/2011 | Thomas et al. | |
| 2011/0048882 | A1 * | 3/2011 | Chiang | A45C 5/03 190/107 |
| 2018/0220763 | A1 * | 8/2018 | Morszeck | A45C 5/03 |
| 2019/0133274 | A1 | 5/2019 | Haimoff et al. | |
| 2020/0345117 | A1 * | 11/2020 | Wang | A45C 5/14 |
| 2022/0000228 | A1 * | 1/2022 | Moon | A45C 5/06 |
| 2024/0115018 | A1 | 4/2024 | Meersschaert | |

FOREIGN PATENT DOCUMENTS

| | | | |
|---|---|---|---|
| JP | H09289914 | A | 11/1997 |
| WO | 2015135502 | A1 | 9/2015 |

OTHER PUBLICATIONS

Extended European Search Report for European Patent Application No. 22200909.4, dated Apr. 3, 2023, 9 pages.
Extended European Search Report for European Patent Application No. 22200910.2 dated Apr. 11, 2023, 7 pages.

* cited by examiner

ZIPPER ASSEMBLY LOOP END ATTACHMENT FOR A LUGGAGE CASE

CROSS-REFERENCE TO RELATED APPLICATION

This application claims priority to European Patent Application No. 22200909.4, filed Oct. 11, 2022 and entitled "Zipper Assembly Loop End Attachment for a Luggage Case", which is hereby incorporated by reference herein in its entirety for all purposes.

BACKGROUND

The present disclosure relates to luggage cases with zip closures and zip arrangements for such cases. One aspect of a luggage case is the zipper assembly, which includes a zipper mechanism. The zipper mechanism is central to opening and closing the luggage case; it impacts the appearance; and is a relatively expensive component affecting the cost of manufacture. The zipper mechanism is also subject to significant wear-and-tear during use and handling. There is a need for improved luggage cases with zip closures, and in particular injection molded luggage cases with an integrally attached zipper assembly or a zipper assembly attached by stitching. There is a need for zipper assemblies for use in luggage cases.

The present disclosure also relates to forming zipper loops from a cut-length of a zipper (or zip) member (including a zipper tape and zipper teeth) for use in attaching a zipper assembly to an injection molded luggage case. The current manners of attaching the ends of a zipper (or zip) member to form a zipper loop lack desired precision, repeatability and efficiency, which can result in the zipper loops being mismatched in length and cause the shells of a luggage case to be mis-aligned. There is a need for an improved attachment structure for precisely and repeatably connecting the ends of a zipper (or zip) member to form a zipper loop that addresses one or all of the noted shortcomings.

The present disclosure also relates to an expansion zipper assembly. Typically the number of expandable and non-expandable luggage cases produced are predetermined based on forecasted demand estimates, because the manufacturing process for each style is distinctly different. This may result in an over, or under, production of either style, which may not satisfy the market demand and result in lost sales or extra costs for additional production. There is a need for an improved expansion zipper assembly that addresses one or all of the noted shortcomings, such as providing the flexibility to convert a luggage case from non-expandable to expandable after a luggage shell is formed and the primary zipper attached, which would allow the production of the desired style of luggage case to be more responsive to market demand.

The present disclosure also relates to end clips that mount onto terminal ends of zippers. End clips are applied to the terminal ends of zipper assemblies to keep the zipper assembly from unintentionally unzipping. Typically one end clip is mounted on each of the opposing ends of a zipper assembly, which forms a gap between the adjacent end clips. The gap may allow access into the internal cavity of the luggage case, and is generally an unsightly feature of a luggage case. Many times the end clips and gap are covered by an aesthetic feature, such as a decorative panel, to cover over the gap. This adds an expense of material and labor.

There is a need for an improved zipper end clip structure that addresses one or all of the noted shortcomings.

SUMMARY

A luggage case is disclosed. In one example, a zipper loop for mounting on a luggage case, and alternatively a luggage case having a zipper loop mounted thereon, is disclosed. The zipper loop includes a first zip member having an elongated first tape member with first zipper teeth extending along an edge, the first zip member having first and second opposing ends, a second zip member having an elongated second tape member with second zipper teeth extending along an edge, the second zip member having third and fourth opposing ends. The first zip member and the second zip member include substantially the same number of zipper teeth, the first zip member and the second zip member are attached together by engaging the first and second zipper teeth, with the first opposing end laterally adjacent the third opposing end, and the second opposing end laterally adjacent the fourth opposing end, the first opposing end attached to the second opposing end by a first joining member, and the third opposing end attached to the fourth opposing end by a second joining member. Additionally or alternatively, the first joining member may be injection molded onto the first opposing end and the second opposing end; and the second joining member may be injection molded onto the third opposing end and the fourth opposing end. Additionally or alternatively, the first joining member may be overmolded to one of the opposing surfaces of the opposing ends of the first tape member; and the second joining member may be overmolded to one of the opposing surfaces of the opposing ends of the second tape member.

Additionally or alternatively, the first joining member may be overmolded to one of the opposing surfaces of the opposing ends of the first tape member; and the second joining member is overmolded to one of the opposing surfaces of the opposing ends of the second tape member. Additionally or alternatively, a cut-out region is formed at each interior corner of the first and second tape members; and each of the first and second joining members extend around the respective cut-out region to define a central opening formed between the first and second zip members. Additionally or alternatively, the first joining member includes a beam extending in alignment with the first zipper teeth; and the second joining member forms a beam extending in alignment with the second zipper teeth, or the first joining member forms one beam at each of the opposing ends, such as for example near an end of the first zipper teeth, and the second joining member forms one beam at each of the opposing ends, such as for example near an end of the second zipper teeth. Additionally or alternatively, the first joining member includes at least one end clip end engaging the first zipper teeth and/or the second zipper teeth. Additionally or alternatively, a first zip member having an elongated first tape member with first zipper teeth extending along an edge, the first zip member having first and second opposing ends and including a first number of first zipper teeth; and the first opposing end attached to the second opposing end by a first joining member overmolded onto the first opposing end and the second opposing end. Additionally or alternatively, each opposing end defines a corner including a portion of the respective tape member and the zipper teeth associated with that portion; and wherein each of the corners is removed to form a cut-out region, and each of the first and second joining members extend around the respective cut-out region.

In another example, a modular expansion zipper assembly is described for use with a luggage case, and includes a first shell having a first zip portion attached along a first rim portion, and a second shell having a second zip portion attached along a second rim portion. The modular expansion zipper assembly includes first and second zip tape members, each including a tape defining zipper teeth extending along opposing outer and inner edges; a flexible gusset attached between the first and second zip tape members; an expansion zip formed by releasably engaging the zipper teeth on the inner edges, the expansion zip converting between a unexpanded position when the zipper teeth are engaged, and an expanded position when the zipper teeth are disengaged; and a first outer zipper edge defined by the zipper teeth on the outer edge of the first zip tape member; a second outer zipper edge defined by the zipper teeth on the outer edge of the second zip tape member; and the first outer zipper edge releasably engaging the first zip member; and the second outer zipper edge releasably engaging the second zip member. Additionally or alternatively, the first and second zip members each define opposing ends; and wherein the opposing ends are attached together by a first joining member overmolded onto the first opposing end and the second opposing end. Additionally or alternatively, the joining member is overmolded to one of the opposing surfaces of the opposing ends of the first and second zip members. Additionally or alternatively, the joining member may include a middle portion positioned along the opposing ends of the first and second zip members, and at least one protrusion extending away from the middle portion; the at least one protrusion forming an end clip on one of the first outer zipper edge, second outer zip edge, or the expansion zip. Additionally or alternatively, the joining member is positioned at least partially on a lower surface of the gusset. Additionally or alternatively, the joining member includes a first rail formed on the first zipper tape and a second rail formed on the second zipper tape, each rail extending from the middle portion at an angle towards the outer edge of the first and second zipper tape, respectively, when the expansion zip is in the expanded position. Additionally or alternatively, the middle portion extends when in the expanded position, and the middle portion folds when in the stowed position.

In another example, a method of making a modular expansion zipper assembly having coil zipper teeth is described, the method comprising the acts of providing a first modular zipper member with right hand coil teeth on a first edge, and a second edge, and a second modular zipper member with left hand coil teeth along a first edge, and a second edge, the first and second modular zipper members engaged along their first edges; separating the first and second modular zipper members; swapping the first and second modular zipper members side for side with the respective second edges adjacent one another; forming matched coil teeth along the adjacent second edges to create an expansion zipper; and attaching opposing portions of a gusset to the first modular zipper member and the second modular zipper member, respectively. Additionally or alternatively, the method may include the act of cutting the engaged first and second modular zipper members to a length, with the first and second modular zipper members having substantially the same number of zipper teeth. Additionally or alternatively, the method may include the act of mounting a slider onto the expansion zipper. Additionally or alternatively, the first and second modular zipper members are engaged together by the expansion zipper and formed into a loop with opposing ends attached together by a joining member, which may be an overmolded joining member. Additionally or alternatively, the method may include the act of engaging the zipper teeth on the first edge of the second modular zipper member with zipper teeth on a first shell of the luggage case; and engaging the zipper teeth on the first edge of the first modular zipper member with zipper teeth on a second shell of the luggage case.

In another example, a first end clip for securing the terminal end of a zipper assembly is disclosed, the end clip including a first end portion for receiving the terminal end of a zipper assembly; and a second portion extending from the first portion and defining an interlocking feature. Additionally or alternatively, the interlocking feature includes a first feature and a second feature symmetrically positioned about a long axis of the second end portion. Additionally or alternatively, the first feature is a protrusion, and the second feature is a through-passage. Additionally or alternatively, a height of the second portion is less than a height of the first portion. Additionally or alternatively, a second end clip having a first portion for receiving another terminal end of a zipper assembly, and a second end portion defining a second interlocking feature; and wherein the interlocking feature of the first end clip engages the second interlocking feature of the second end clip to secure the two end clips together. Additionally or alternatively, the second interlocking feature includes a first feature and a second feature; and the first feature on the first end clip engages the second feature on the second end clip, and the second feature on the first end clip engages the first feature on the second end clip to secure the two end clips together. Additionally or alternatively, when engaged together the first and second end clips form a unitary body.

In another example, a luggage case includes a zipper loop mounted thereon, the zipper loop including a first zip member having an elongated first tape member with first zipper teeth extending along an edge, the first zip member having first and second opposing ends, the first zip member attached along a first rim portion of a first shell; a second zip member having an elongated second tape member with second zipper teeth extending along an edge, the second zip member having third and fourth opposing ends, the second zip member attached along a second rim portion of a second shell, and wherein the first zip member and the second zip member include substantially the same number of zipper teeth, the first zip member and the second zip member are attached together by engaging the first and second zipper teeth, with the first opposing end laterally adjacent the third opposing end, and the second opposing end laterally adjacent the fourth opposing end; the first opposing end attached to the second opposing end by a first joining member overmolded onto the first opposing end and the second opposing end; and the third opposing end attached to the fourth opposing end by a second joining member overmolded onto the third opposing end and the fourth opposing end. Additionally or alternatively, the first joining member may be overmolded to one of the opposing surfaces of the opposing ends of the first tape member; and the second joining member may be overmolded to one of the opposing surfaces of the opposing ends of the second tape member. Additionally or alternatively, a cut-out region is formed at each interior corner of the first and second tape members; and each of the first and second joining members extend around the respective cut-out region to define an opening formed between the first and second zip members. Additionally or alternatively, the first joining member forms at least one beam extending from the first zipper teeth, and the second joining member forms at least one beam extending from the second zipper teeth; or the first joining member forms one beam at each of the opposing ends of the first zipper teeth, and the second joining member forms one beam at each of the opposing ends of the second zipper teeth. Alternatively or additionally, the first joining member includes at least one end clip engaging the first zipper teeth and/or the second zipper teeth.

Additionally or alternatively, the luggage case versions above may further include a modular expansion zipper assembly comprising a first and second zip tape members, each including a tape defining zipper teeth extending along opposing outer and inner edges; a flexible gusset attached between the first and second zip tape members; an expansion zip formed by releasably engaging the zipper teeth on the inner edges, the expansion zip converting between a unexpanded position when the zipper teeth are engaged, and an expanded position when the zipper teeth are disengaged; and a first outer zipper edge defined by the zipper teeth on the outer edge of the first zip tape member; a second outer zipper edge defined by the zipper teeth on the outer edge of the second zip tape member; and the first outer zipper edge releasably engaging the first zip member; and the second outer zipper edge releasably engaging the second zip member. Additionally or alternatively, the joining member may include a middle portion positioned along the opposing ends of the first and second zip tape members, and at least one protrusion extending away from the middle portion; the at least one protrusion forming an end clip on one of the first outer zipper edge, second outer zip edge, or the expansion zip. Additionally or alternatively, the joining member may be positioned at least partially on a lower surface of the gusset. Additionally or alternatively, the joining member includes a first rail formed on the first zip tape member and a second rail formed on the second zip tape member, each rail extending from the middle portion at an angle towards the outer edge of the first and second zip tape member, respectively, when the expansion zip is in the expanded position. Additionally or alternatively, the middle portion may extend when in the expanded position, and the middle portion folds when in the stowed position.

Additionally or alternatively, the luggage case versions may include a first end clip for securing the at least one first beam and the at least one second beam, the end clip including a first end portion for receiving the at least one first beam and the at least one second beam; and a second portion extending from the first portion and defining an interlocking feature. Additionally or alternatively, the interlocking feature includes a first feature and a second feature symmetrically positioned about a long axis of the second end portion. Additionally or alternatively, the first feature is a protrusion, and the second feature is a through-passage. Additionally or alternatively, a second end clip for securing the beams at the opposing ends of the first and second zipper teeth respectively, the second clip having a first portion for receiving the beams, and a second end portion defining a second interlocking feature; and wherein the interlocking feature of the first end clip engages the second interlocking feature of the second end clip to secure the two end clips together. Additionally or alternatively, the second interlocking feature includes a first feature and a second feature; and the first feature on the first end clip engages the second feature on the second end clip, and the second feature on the first end clip engages the first feature on the second end clip to secure the two end clips together.

An example of the invention described herein may relate to efficiently, precisely and repeatably attaching the opposing ends of the zipper loop so that each portion of the zipper loop has the intended number of zipper teeth for proper alignment and function.

An example of the invention described herein may relate to a modular expansion zipper assembly that may be implemented on a luggage case after the shells have been formed and the primary zipper (or zip) members attached.

An example of the invention described herein may related to end clips positioned on opposing ends of a zipper assembly that engage one another to form a reinforced end clip structure and reduce the size of or cover the hole that is typically formed at that location.

Additional embodiments and/or features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

An improved injection molded luggage case as described herein may include a zipper assembly attached to each shell of the luggage case. The zipper assembly may be attached by stitching, or in some examples may be attached during the injection molding step. Attaching the zipper assembly during the injection molding step can simplify construction of the luggage case by eliminating the step of attaching the zipper assembly after the luggage shells are formed. This reduces the complexity and number of operations associated with assembling a luggage case.

An improved zipper loop is described herein, and may be useful in one example for attaching to an injection molded luggage shell by stitching, or alternatively it may be attached during the injection molding process. A zipper loop is formed from a cut-length of a zipper assembly or a zipper (or zip) member portion of a zipper assembly. The opposing ends of the cut-length of the zipper assembly may be attached together by overmolding a joining member onto the opposing ends. The overmolded joining member allows precise and secure positioning of the opposing ends to help insure the zipper loop is properly sized and may withstand the tension imparted during the manufacturing process, such as attaching the zipper loop to the injection molded shell. The overmolded joining member may be used on zipper assemblies intended for non-expandable luggage cases, as well as expandable zipper assemblies for expandable luggage cases.

Also described herein, separate from or in combination with other disclosures herein, is an expansion zipper assembly that is modular and may be applied to a luggage case after the shells are formed and the primary zipper assembly is attached to the shells, such as by stitching, or alternatively, by bonding a primary zipper (or zip) member to each shell when the shell is formed by injection molding. The modular nature of the expansion zipper assembly allows luggage shells styled as non-expandable to be converted to expandable luggage cases.

Also described herein, separate from or in combination with other disclosures herein, is an end clip that mounts onto each of the opposing terminal ends of a zipper assembly, and that interconnects the opposing ends of the zipper assembly. The end clip includes an interlocking feature, such that two end clips may be connected together with or by the interlocking feature on each end clip. The connected end clips form a reinforced end clip structure that eliminates or reduces the typical gap formed between adjacent end clips, and may provide a finished appearance.

Figure 1:
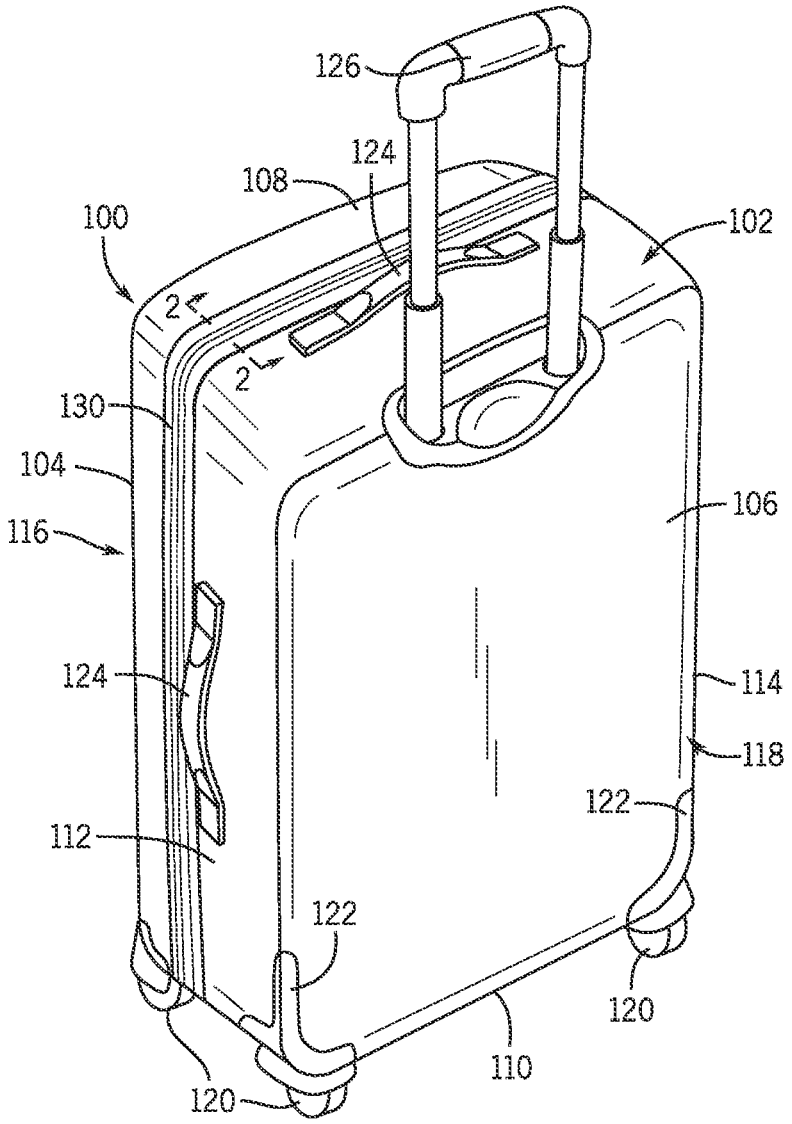
FIG. 1 is an isometric view of a luggage article in a closed configuration including a zipper assembly according to some examples of the present disclosure.

FIG. 1 is an isometric view of a luggage article in a closed configuration according to some examples of the present disclosure. A luggage article 100 according to an embodiment of the present disclosure includes a luggage case 102 formed from a plurality of walls or panels defining an internal compartment and storage volume in which to carry a user's belongings. As shown, the luggage article 100 includes a front panel 104, opposing a rear panel 106, a top panel 108, opposing a bottom panel 110, and a left panel 112 opposing a right panel 114 that collectively define a pair of opposing shells 116, 118 and the outer structure of the luggage case 102. As shown, a plurality of wheel assemblies 120, which may be caster-type wheel assemblies, may be coupled to at least the bottom panel 110, such as at the lower corner regions 122.

The luggage article 100 may also include one or more carry handles 124, typically on the top panel 108 and one of the side panels, such as 112. The luggage article 100 may also include an extendable or telescopic tow handle 126 attached to at least one panel of the luggage case 102, such as to the rear panel 106.

With continued reference to FIG. 1, the luggage case 102 in this example comprises two shells 116, 118 secured by a zipper assembly 130, for example a primary zipper assembly 130 (as referred to when used to selectively couple the shells 116, 118), extending across all or portions of at least the top panel 108, left panel 112, right panel 114 and bottom panel 110. The primary zipper assembly 130, or portions thereof, may be attached to a rim portion, such as a peripheral rim, formed on each shell by stitching, or in the alternative, during the injection molding process for forming the shell. A hinge structure (not shown) may be formed on the right panel 114 such that the two shells of the luggage case 102 may rotate about the hinge to access the interior volume of the luggage case 102. The shells each may define an inner surface and an outer surface, and may be formed from materials used to construct injection molded hard-sided or rigid luggage cases, such as a plastic material, such as polypropylene, polycarbonate, polyethylene, or other thermoplastic materials.

Figure 2:
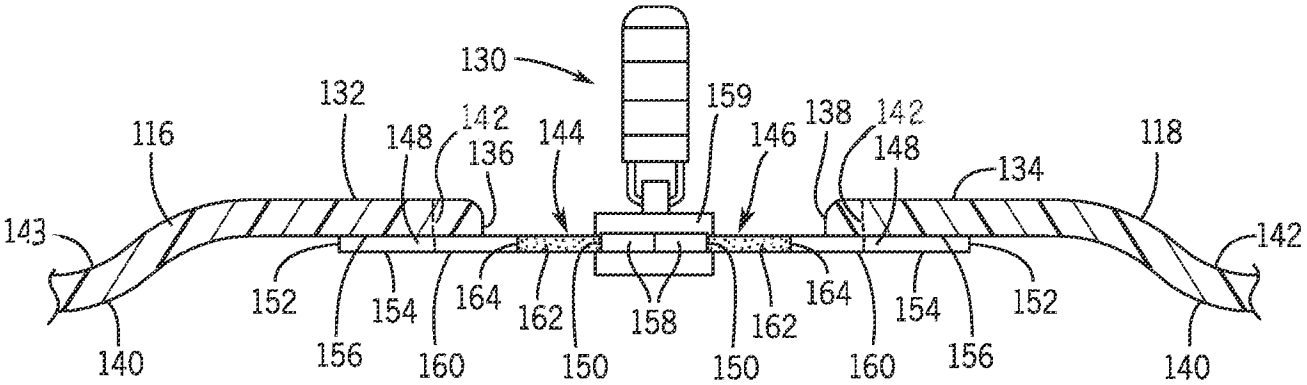
FIG. 2 is a section view taken along line 2A-2A of FIG. 1.

FIG. 2 shows an enlarged portion of one example of the luggage case 102 of the present invention, where the rim portion 132 of the first shell 116 and the rim portion 134 of the second shell 118 are secured together by the primary zipper assembly 130. The primary zipper assembly 130 may be attached to the rim portion 132 by stitching 142 (shown in dash in FIG. 2), or in other examples may be attached during the injection molding of the first and second shells 116, 118. Each rim portion 132, 134 defines a peripheral edge 136, 138 and opposing inside (or inner) 140 and outside (or outer) 143 surfaces. The primary zipper assembly 130 may include a first primary zipper (or zip) member 144 and a second primary zipper (or zip) member 146. The primary zip members 144, 146 each include a respective elongated tape member 148 having opposing inner 150 and outer 152 edges defining a width, and also have opposing inner 154 and outer surfaces 156. Zipper teeth 158 extend along one opposing edge of each tape member 148, such as the inner edge 150. Zipper teeth 158 may include individual teeth elements (plastic or metal), or coil structures, and are herein referred to generally as "zipper teeth". The first and second primary zip members 144 and 146, and their respective tape members 148 and zipper teeth 158 generally include the same structural features and function. Throughout, only one zip member and subcomponents may be described, with the understanding that the other zip member is symmetric and substantially identical unless otherwise noted.

As shown in FIG. 2, the zipper teeth 158 are releasably secured together, such as by a slider 159. Each of the first 144 and second 146 primary zip members may be attached by stitching 142 (shown in dash), or in other examples may be bonded by injection moulding to the rim portion 132, 134 of the respective shell 116, 118. The bonding occurs during the injection molding formation of the shell, and is referred here throughout as in-mould-bonded or variants. In one example, as shown in FIG. 2, each of the first 144 and second 146 primary zip member may be in-mould-bonded to the inside surface 140 of the respective rim portion 132, 134. In one example, all or a part of the outer surface 156 of the first and second tape members 148 may be in-mould-bonded to the inside surface 140 of the rim. In one example, all or part of the inner surface 154 of the tape member 148 may not be directly bonded to or attached with the respective rim portion 132, 134. In other examples, the primary zipper members 144, 146 may be attached to the rim portions 132, 134 by means such as adhesives, mechanical engagement or other types of fastening mechanisms.

As shown in FIG. 2 (with the rims 132, 134 shown in dash for clarity), the tape member 148 of the zipper assembly 130 defines a first portion 160 and a second portion 162 across the width between the inner 150 and outer 152 edges. The first and second portions may extend along the entire length, or at least a part of the length, of the tape member. The first portion 160 of the tape member 148 is made of a first material or combination of materials (collectively the "first material") that allow in-mould-bonding to the rim portion 132, 134 of the luggage shell 116, 118 during the injection molding process. The second portion 162 of the tape member 148 is made of second material or combination of materials (collectively the "second material") that is selected for its resistance to abrasion, such as the abrasion caused by a zipper slider 159 moving along the second portion 162 of the tape member 148. In some examples the second material, separately or in addition, may not facilitate in-mould-bonding to the respective rim portion 132, 134 during the injection molding process. The second material may include material types in common with the first material, but includes other material types to make it sufficiently different than the first material such that the second material has abrasion resistance characteristics enhanced relative to the first material in the first portion 160. As a result, the rim 132, 134 may be in-mould-bonded to the first portion 160 of the tape member 148, and the second portion 162 of the tape member 148 may withstand the wear and tear of the abrasion caused by the frictional contact of the slider 159 moving along the second portion 162 of the tape member 148. The second material may not in-mould-bond, or may only partially bond, with the second portion 162 of the tape member 148 (if exposed to the mold material during the molding process). In one example, the first material making up the first portion 160 may include polypropylene, and the second material making up the second portion may include polyester. In another example, the first material making up the first portion 160 may include polypropylene and the second material making up the second portion may include polyester and polypropylene. The other tape member 148 of the zipper assembly 130 may be identically constructed with the same or similar features as described above.

As shown in FIG. 2, in one example, at least part of one side of the tape member 148 is in-mould-bonded to the inner, or inside, surface 140 of the rim portion 132, where the rim portion 132 overlays the tape member 148. The other side of the tape member 148 may not be in-mould-bonded to the rim portion 132. In this example, the one side that is in-mould-bonded is the outer surface 156 of the tape member 148. In another example, at least part of the outer surface 156 of the tape member 148 is in-mould-bonded to the inside surface 140 of the respective rim portion 132, 134, where the rim portion 132 overlays at least the first portion 160 of the tape member 148. In some examples, such as where the rim overlays only the first portion 160, the in-mould-bond is created between the outer surface 156 of the tape member and the inside surface 140 of the respective rim portion 132, 134 where the rim overlays the tape member.

The second material may be selected to have different characteristics than the first material. For example, the second material included in the second portion 162 may have a different characteristic in that it may have an enhanced resistance to abrasion relative to the first material. The abrasion-resistant characteristics may allow the second portion 162 to withstand the wear and tear of repeated frictional sliding contact with the slider 159 as it moves along the zipper teeth 158 to open and close the primary zipper assembly 130. In another example, separately or in combination with the abrasive resistance, the second material may not bond to the material used to form the shell or shells by injection molding. Another optional characteristic, either separately or in combination with the other characteristics, of the second material may be that it is more water resistant, such as being less water absorptive, than the first material. In one example, the second portion 162 may include weft yarns that are the same as the first material, such as for example polypropylene. The warp yarns in the second portion 162 may be another material, such as for example polyester or nylon. The polyester or nylon material has a higher abrasion resistance than the first material and in combination with the weft yarns is more resistant to abrasion than the first material. Additionally or separately, this example may not in-mould-bond with the first material used in the injection molding process to form the luggage shell. The zipper teeth 158 may be made of POM (for the injection molded zipper teeth) or nylon or polyester (for the coil zipper teeth).

In another example of the tape member, each tape member 148 may be an extruded strip or strips of at least two different thermoplastic material or materials. A first portion 160 of each tape member 148 may be adjacent the first edge 152 of the tape member 148, and a second portion 162 adjacent a second edge 150 of the tape member. The first portion 160 may be made of a first material, and the second portion 162 made be made of a second material.

In the molding process, the injection molding material flows over the surface of the tape member 148 that is exposed in the mold cavity. The mold material bonds to the surface of the tape member 148 as a result, and is referred to herein as in-mould-bonding. The in-mould-bonding may be created by a combination of chemical bonding and mechanical bonding. The chemical bonding may include adhesion (generally between two materials that are not the same), cohesion (generally between two materials that are the same or very similar), and/or other types of bonding that may otherwise occur between two materials in the environment of heat and pressure as a result of the injection mold process. Mechanical bonding may occur as the injection mold material at least partially penetrates into and forms around the weave pattern of the warp and weft yarns to which the mold material mechanically attaches/engages when cooled. The bonding is referred to as in-mould-bonding because it is accomplished within the mold components during the injection molding process to form the shell. The in-mould-bond is formed over an area of the surface of the tape member 148 that is exposed in the mold cavity to the mold material during the injection molding process. In one example, the outer surface 156 of the first portion 160 of the tape member 148 is exposed in the mold cavity, and is in-mould bonded to the rim 134 of the luggage shell 116, 118. In some example, the in-mould-bonding is limited to one side (for example, the outer side 156) of the tape member 148.

Figure 3:
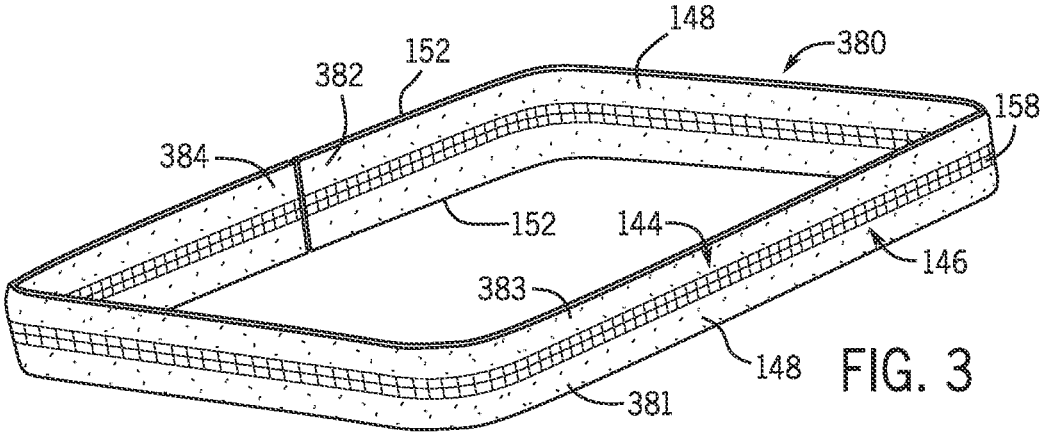
FIG. 3 is a perspective view of a zipper loop.

FIG. 3 shows a matched zipper loop 380 formed by a first primary zip member 144 and a second primary zip member 146 attached together by their respective zipper teeth 158. The first primary zip member 144 forms a first primary loop 381, and the second primary zip member 146 forms a second primary loop 383. The matched zipper loop 380 may be formed by cutting a defined portion of matched first 144 and second 146 primary zip members and attaching the opposing free ends 382, 384 together. The cut portion of the matched first 144 and second 146 primary zip members may be based on the number of teeth on each portion, or may be based on the length of each portion. In one example, the number of teeth on each of the first 144 and second 146 primary zip members are the same. Because the teeth 158 are generally of the same or similar size and are generally regularly spaced along the zip members, cutting the matched first 144 and second 146 primary zip members to the same length likely results in each zip member having the same number of teeth.

Figure 4:
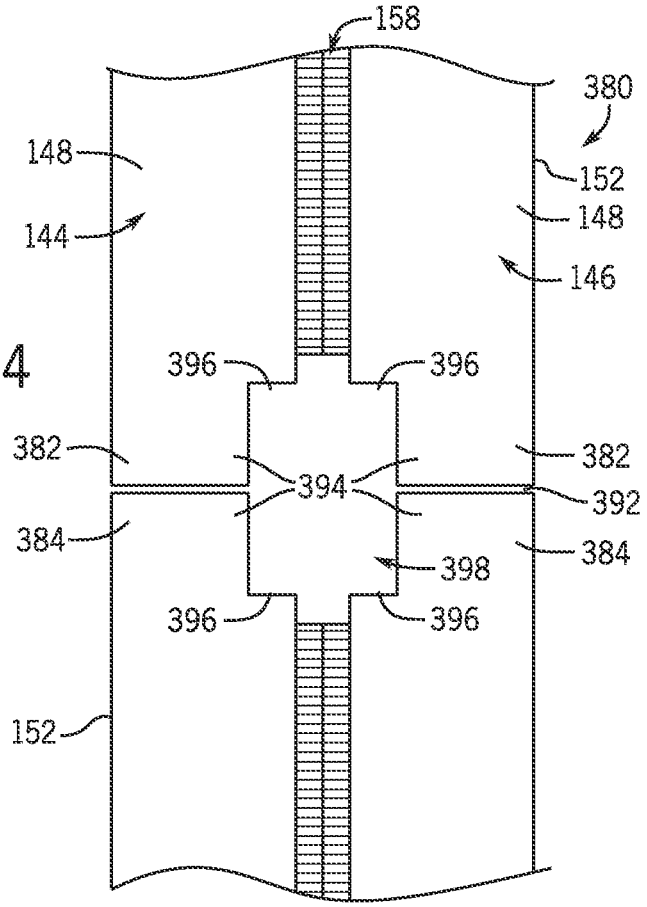
FIG. 4 is an enlarged view of the opposing ends of the zipper loop of FIG. 3.
Figure 5:
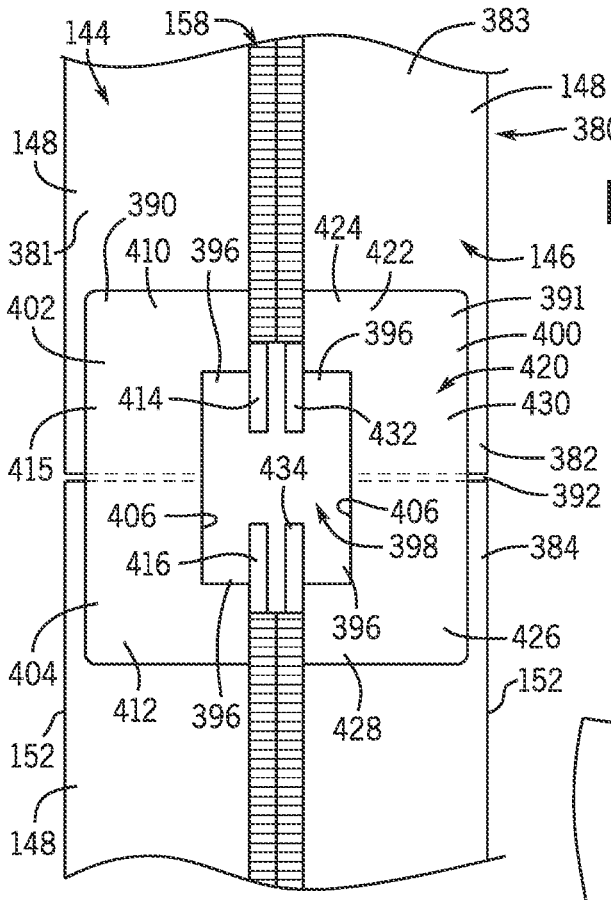
FIG. 5 is an enlarged view similar to FIG. 4 showing joining members engaging the opposing ends of the zipper loop together.
Figure 6:
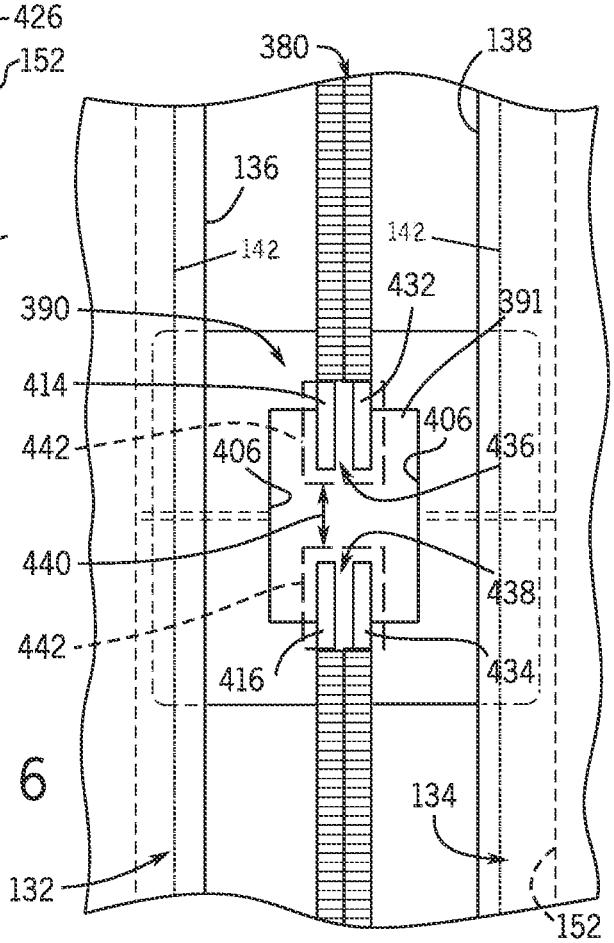
FIG. 6 is an enlarged view similar to FIG. 5, showing end clips positioned on the ends of the zipper.

Referring to FIGS. 4-6 generally, the free ends of each primary zip member may be attached together when the first and second primary zip members 144, 146 are attached by their respective teeth, or may be attached together after the primary zip members 144, 146 are separated. As described herein, in one example the primary zipper tape members 144, 146, once formed into a loop 380, may be separated from one another into first and second primary loops 381 and 383, and each separately positioned in a separate mold cavity in order to be bonded to a respective shell 116, 118 during the injection molding process. Also, each primary zip member 144, 146 may be cut into a desired portion (for example defined by a desired number of zipper teeth) and formed into a loop independently from the other.

The free ends 382, 384 of each primary zip member 144, 146 may be attached directly together, with the respective free ends abutted or overlapping, by stitching, adhesives, ultrasonic welding, bonding, or by other means. The free ends 382, 384 may also be attached together, with the respective free ends abutted, overlapping, or spaced apart, by one or more separate joining members.

Referring still to FIGS. 4, 5 and 6, each of the matched first and second primary zip members 144, 146 may be paired for use together, each on its own luggage shell, in a luggage case 102, or may be used interchangeably with other luggage shells including primary zip members 144, 146 having the same or similar number of teeth. Each of the matched first and second primary zip members 144, 146 may be bonded to their respective shell in the injection molding process. In other examples, each of the matched first and second primary zippers 144, 146 may be attached by stitching to each shell after each shell is formed. Each shell may then be matched with any other shell having a corresponding zip member with the same or similar number of teeth. Each of the matched first and second zip members 144, 146 include a respective first and second zipper tape member 148 and associated first and second zipper teeth 158. As noted above, each of the first and second zipper tape portions 144, 146 have the same or similar number of first and second zipper teeth 158, respectively. Having the same or similar number of teeth on each zip member allows the zip members to adequately engage one another when respectively attached to a luggage shell, with the benefits described below. In one example, a luggage case having a zipper length of 225 cm includes approximately 1250 teeth on each zip member (each tooth is approximately 1.8 mm). The difference in the number of teeth between the first and second primary zip members 144, 146 may be in a range of approximately 0.1% to 1% in one example, and approximately 0.1% to 0.3% in another example, and may be a particular value of 0.2% in another example. In another example, the difference in the number of teeth 158 on each of the first and second primary zip members 144, 146 may be +/−2 teeth, or in other words approximately 0.16%.

Because the first and second zip members 144, 146 have the same or substantially the same number of zipper teeth, and the zipper teeth are similarly sized and evenly spaced, the first and second zipper tape portions 148 may be the same or substantially the same length as one another.

The similarity in number of teeth of each of the matched first and second primary zip members 144, 146 attached to paired luggage shells 116, 118 in a luggage case 102, whether by in-mould-bonding or in other examples via stitching 142 (shown dashed in FIG. 6), is beneficial for many reasons. For example, when the luggage shells are connected together by the matched first and second primary zip members 144, 146, the luggage shells 116, 118 may have little to no deformation relative to one another. Minimal deformation means that the luggage case does not appear mis-shaped or twisted, and/or the support members, such as the wheels, may each contact the support surface (e.g. floor) together. Additionally or independently, in some examples, where the first and second primary zip members 144, 146 have substantially the same or similar number of teeth 158, the engagement and disengagement of the zipper teeth by the slider to open and close the luggage case may occur more smoothly, and the zipper slider may more easily correct the occasional mismatched zipper teeth. In the same or other examples, such as where the primary zip members are attached to the shell by in-mould-bonding, the respective zipper tape portions of the first and second primary zip members 144, 146 may stretch or expand approximately the same amount when being positioned in a respective mold cavity, and thus have the same or a similar level mold tension level prior to the injection molding step of their respective shell. They may also have the same or similar residual tension level after the respective shell is formed and shrinks after removal from the mold. A same or similar residual tension level aids in the zip members on two paired shells operating smoothly together over repeated use, and reduces the likelihood of inconvenient misalignments that may damage the zipper teeth and overall operation.

Continuing with FIGS. 4-6, the opposing ends 382, 384 of the first and second primary zip members 144, 146 may be attached together by a joining member 390 to form the matched primary zipper loop 380, made up of the first primary loop 381 and the second primary loop 383. Alternatively, the respective opposing ends 382, 384 of each of the primary first and second zip members 144, 146 may be joined together to form individual zipper loops where the first and second zip members 144, 146 are separated. As noted above, each primary zip member may include a tape member 148 with zipper teeth positioned along one edge. The joining member 390 may connect opposing ends 382, 384 of one primary zip member 144 to form the first primary zipper loop 381, with the structure and features being similar to or the same for connecting the opposing ends 382, 384 of the other primary zip member 146 to form the second primary zipper loop 383 with a joining member 391, unless otherwise noted.

Referring to FIGS. 4, 5, and 6, the attachment by the joining member 390 of the opposing ends 382, 384 of the first zip member 144 is shown. The joining member 390 is applied to each of the opposing ends 382, 384 of the first zip member 144 and secures the opposing ends together. The joining member 390 may be attached to both ends of the first zip member 144 by stitching, adhesive, or bonding (such as by injection moulding) to engage each opposing end 382, 384 and hold the ends in position relative to one another. The joining member 390 may sustain a tension load of approximately 200 N, which may occur as the first primary loop 381 is stretched prior to being positioned in a mould for an injection mould process. Once the respective shell 116 is formed, the opposing ends 382, 384 of the first primary loop 381 are held in place by the in-mould-bond between the inner surface 140 of the rim portion 132 of the shell 116 and the outer surface 156 of the tape portion 160. In one example, the joining member 390 is made of a thermoplastic injection molded material applied by an injection molding process. In one example the injection molding process may be overmolding. The joining member 390 may be applied to either or both of the opposing surfaces 154, 156 of the first zipper tape member 148. In the example shown herein the joining member 390 is applied to the outer surface 156 of the first zipper tape member 148. The joining member 390 may cover all or part of the width of the tape member 148.

Referring to FIG. 4, in one example, the opposing ends 382, 384 are shown prior to the joining member 390 being attached. A gap 392 is formed between the opposing ends 382, 384 and the joining member will span the gap 392 and maintains its dimension. Alternatively, the opposing ends 382, 384 of the primary zip member 144 may abut or overlap and be held in place by the joining member 390. As shown, each interior corner 394 of each tape member 148 may define a notch 396, in which the teeth 158 are removed, as well as some of the width of the tape member 148. When configured together as a matched zipper loop 390 as shown, the notches 396 form a cut-out area 398 positioned along an inner edge of each tape member 148.

Turning to FIG. 5, the joining member 390, in one example, may have a plate-like main body 400 with a first end 402 attached to the tape member 148 of the first opposing end 382, and a second end 404 attached to the zipper tape member 148 of the second opposing end 384. The first and second ends 402, 404 of the main body 400 are positioned adjacent the zipper teeth 158 of the respective opposing end.

The main body 400 of the joining member 390 may define a cut-out 406 [add to FIGS. 5 and 6] positioned along an inner edge and extending between the first 402 and second 404 ends. In one example the cut-out 406 results in the main body 400 having a C-shape, with a first leg 410, a second leg 412, and a main leg 415 extending between the first and second legs. The cut-out area 406 of the joining member 390 may match the cut-out area 396 in the first primary zip member 144 where the joining member 390 overlaps with the tape member 148.

The first end 402 may include a first beam 414 extending longitudinally away from and in alignment with the teeth 158 on the first opposing end 382. The first beam 414 may extend inwardly from the first leg 410 of the C-shape. The second end 404 may include a second beam 416 extending inwardly from the second leg 412. The first beam 414 and the second beam 416 extend longitudinally away from and in alignment with the respective teeth 158 on the respective first 382 and second 384 opposing end. Each of the first and second beams 414, 416 may define a lateral dimension that is less than the lateral dimension of the adjacent zipper teeth 158.

With continuing reference to FIG. 5, and as referenced above, the second primary zip member 146 may use a second joining member 391 to secure its opposing ends together to form the second primary loop 381. As with the first joining member 390, the second joining member 391 may be similar to the first joining member 390, and may in some examples have a reverse orientation as shown. The second joining member 391 may include a main body 420 in a reverse C-shape, with a first end 422 defining a first leg 424, a second end 426 defining in part a second leg 428, and a main leg 430 extending between the first leg 424 and second leg 428. A first beam 432 may extend from the first leg 424 in a direction away from and in alignment with the zipper teeth 158. A second beam 434 may extend from the second leg 428 in a direction away from and in alignment with the zipper teeth 158. Each of the first and second beams 432, 434 of the second joining member 391 may define a lateral dimension that is less than the lateral dimension of the adjacent zipper teeth 158.

The joining members 390 and 391 may be applied by injection molding to the opposing ends 382, 384 of the respective primary zip member 144, 146, such as for example when the primary zip members are joined together to form the matched loop 380, or when the primary zip members 144, 146 are separated. In one example the injection molding is overmolding, which applies the joining member to the surface of the respective tape members 148.

Referring to FIG. 6, the matched first and second primary zip members 144, 146 from FIG. 5 may be separated before being in-mould-bonded with respective rim portion 132, 134 of a respective luggage shell 116, 118. As a matched pair, the first and second primary loops 381, 383 are aligned on their respective shells 116, 118 so that the beams 414 and 432 on the first opposing ends 382 are adjacent one another to form a first lateral pair of beams 436. Similarly, the beams 416 and 434 on the second opposing ends 384 may be adjacent each other to form second lateral pair of beams 438. A slight space or gap is formed between the beams in each lateral pair to allow a slider to receive both beams and actuate the zipper teeth to mate or disengage as is desired.

Also referring to FIG. 6, a mounting gap 440 may be formed between the first lateral pair of beams 436 and the second lateral pair of beams 438 to allow application of sliders, slider end clips, end caps, and/or other mechanisms 442 needed to operate the zipper, restrict the length of zipper slider actuation along the zipper assembly, and/or terminate the zipper, respectively. As shown in FIG. 6, the first and second lateral pair of beams 436, 438 may be located in the same plane, with the size of the mounting gap 440 insufficient to allow one of the mechanisms noted above to be mounted onto the teeth of the matched zipper loop 380. A mechanism may be mounted by, for instance, deflecting one of the lateral pairs of beams downwardly, such as for example the second lateral pair of beams 338 (into the page of FIG. 6), to temporarily create sufficient space to apply the mechanism to the first lateral pair of beams 336. Once the mechanism is applied, then the first lateral pair of beams 336 may be deflected downwardly to apply a mechanism to the second lateral pair of beams 338 in a similar manner.

Figure 7:
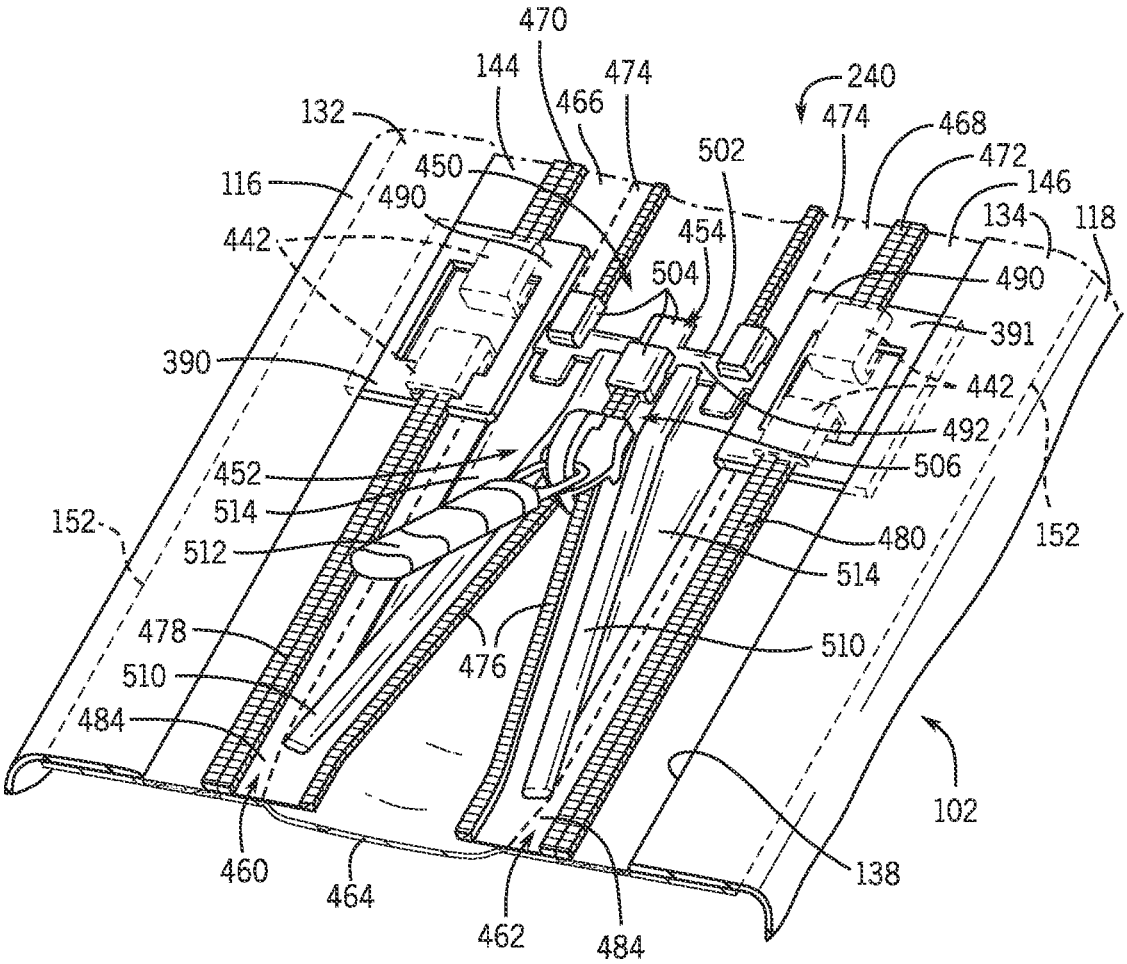
FIG. 7 is an enlarged perspective view of a modular expansion zipper assembly in the expanded configuration.

Referring to FIGS. 7, 8*a*, 8*b*, and 9, one example of the modular expansion zipper is shown. In this example, the modular expansion zipper 240 may be configured in a zipper loop for attaching between the first primary 144 and second primary 146 zip members. The opposing ends 450, 452 of the modular expansion zipper 240 may be secured together by overmolding a joining member 454 between the free ends, similar to the joining members 390, 391 described above in FIGS. 3-6. The first primary and second primary zip members 144, 146, in one example as shown in FIG. 7, may be in-mould-bonded to their respective luggage shells 116, 118 during the injection molding process forming the shells. The modular expansion zipper 240 may be used to convert an unexpandable luggage case into an expandable luggage case. The luggage articles with which the modular expansion zipper 240 may be used may include luggage cases with hard side shells, soft sided luggage cases, and hybrid luggage cases (combination of hard side and soft side construction). Additionally, the modular expansion zipper 240 may be used with duffle bags, backpacks, and other zippered items.

Referring to FIG. 7, the modular expansion zipper assembly 240 is shown in the expanded position, with the gusset 464 in an extended position. The expansion zipper assembly 240 of this example includes a first 460 and second 462 modular zip tape member, and a gusset 464 extending between the first 460 and second 462 modular zip members. Each of the first and second modular zip members includes a respective modular zipper tape 466, 468. Each zipper tape defines inner and outer opposing side edges both having zipper teeth. The outer edge of the first modular zip member 460 defines the first outer zipper edge 470 of the modular zipper expansion assembly 240. The outer edge of the second modular zip member 462 defines the second outer zipper edge 472 of the modular zipper expansion assembly 240. The zipper teeth on the adjacent inner edges 474 of each modular zip member form the expansion zipper 476 to expand and stow the gusset 464. Opposing edges of the gusset 464 may each be attached to a respective first 466 and second 468 modular zipper tapes by stitching. The gusset 464 may be of a flexible material that may fold and gather when in the stowed or unexpanded position, and extend to a full width when in an expanded position.

The modular expansion zipper assembly 240 is formed into a zipper loop for application between the first primary 144 and second 146 primary zip member of the luggage case 102. The loop is formed of a length of the modular expansion zipper assembly cut to the same as or similar length of the first primary and second primary zip members 144, 146. This is beneficial so that when the expansion zipper assembly 240 is applied between the first primary 144 and second 146 primary zip member of the luggage case 102, both the access zipper 478 and the construction zipper 480 open and close properly, as well as so the two shells of the luggage case are not warped or mis-aligned due to uneven zipper lengths.

Figure 9:
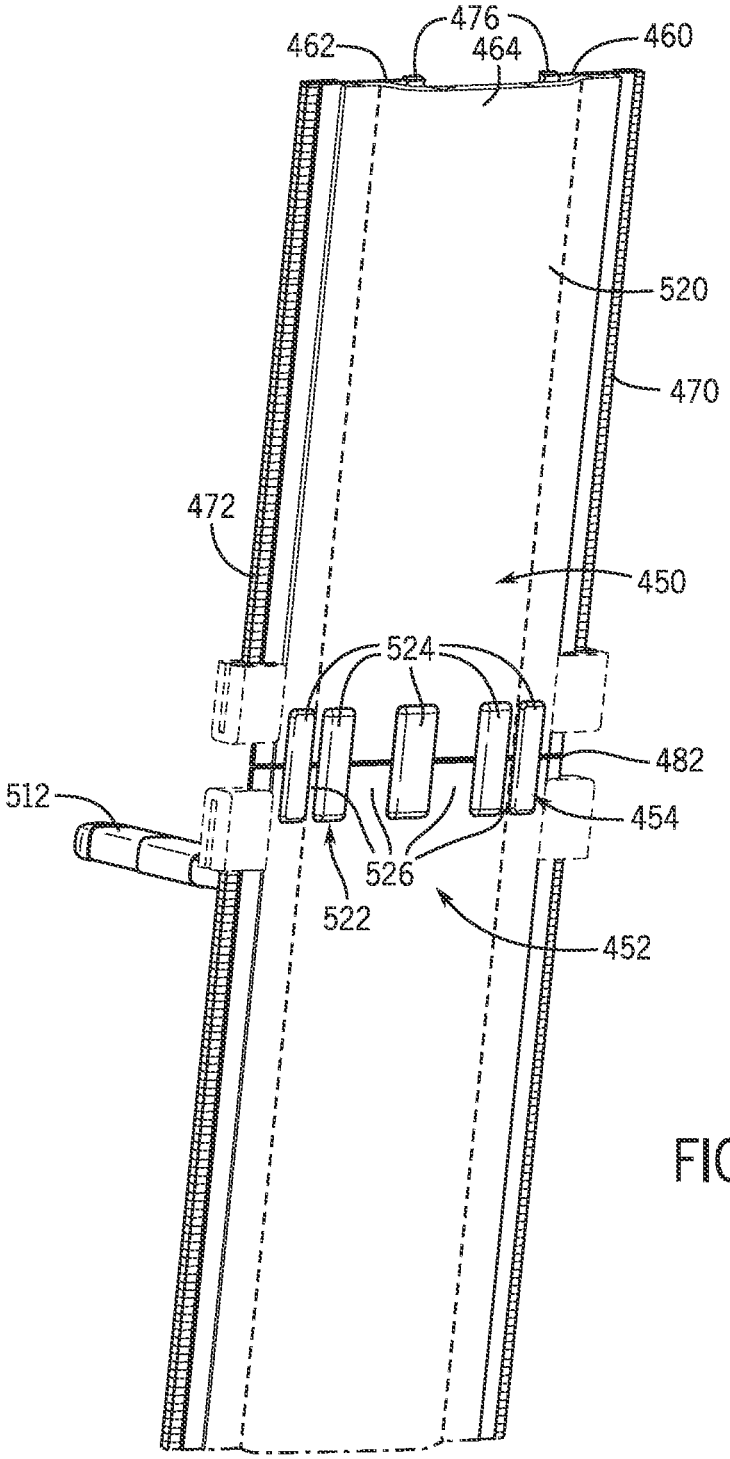
FIG. 9 is an enlarged perspective view of the underside of a modular expansion zipper assembly.

The securing of the opposing ends 450, 452 of the cut length of the modular expansion zipper 240 to form a zipper loop may be done by overmolding a joining member 454 between the opposing ends to secure them together. The opposing ends 450, 452 may be overlapping, abutting, or spaced apart a desired amount (such as, for example, 1 to 3 mm). The joining member 454 may be made of an injection moldable plastic that bonds with the zipper tape 466, 468 used in the modular expansion assembly 240. For example, the plastic may be thermoplastic or thermo-set plastic. Examples of the plastic material include being the same as the first material, which would facilitate recycling of the luggage shell. Other examples of materials may include TPU. The opposing ends 450, 452 of the cut length are positioned in an injection mold cavity in the configuration in which they are to be secured together, such as with a small gap 482 between the opposing ends best seen in FIG. 9). The joining member 454 may be applied to the exterior surface of the modular expansion zipper assembly 240. In another example, the joining member 454 may be applied to the exterior surface of the expansion zipper assembly and to the interior surface (facing the interior of the luggage case) of the gusset 464 as shown in FIG. 9, and described in further detail below.

The joining member 454 may be injection molded onto the modular expansion zipper assembly to extend over and bond with at least an outer surface 484 of each of the opposing ends 450, 452 of the zipper tapes 466, 468 to secure them together. The joining member 454 may extend continuously or discontinuously from the outer edge 470 to the outer edge 472 and overlie the gap. The joining member 454 may include opposing end portions 490 and a middle portion 492. The end portions 490 may each be adjacent an outer edge 470, 472, and may be in the form similar to the joining member 390, 391 described above with respect to FIGS. 5 and 6. The end portion 490 adjacent outer edge 470 may be aligned with joining member 390 formed on the first primary zip member 144, and may have a structure similar to joining member 391 in order to match with the beams 414 and 416 (FIG. 6) to form the lateral beam pairs needed to accept the mechanism 442 onto the matched zipper. Similarly, the opposing end portion 490 adjacent outer edge 472 may be aligned with joining member 391 formed on the second primary zip member 146, and may have a structure similar to joining member 390 in order to match with the beams 432, 434 (FIG. 6) to form the lateral beam pairs needed to accept the mechanism 442 onto the matched zipper.

Continuing with FIG. 7, the middle portion 492 of the joining member 454 may, in one example, define a central extension 502 generally aligned with the gap 482, and having protrusions 504 extending outwardly away (in the direction of the zipper) from the central extension 502 of the middle portion 492. The protrusions 504 may be spaced apart to allow the central extension 502 to bend or fold in between the protrusions 504 to collapse when the gusset is in the stowed or collapsed position (see FIG. 8*a*). Where a protrusion 504 extends over a terminal end of a zipper, such as the expansion zipper teeth positioned along edges 474, the protrusion 504 may overmould the zipper teeth to form an integrated clip-end. One protrusion 504 may be formed over and encompass a terminal end 506 of the expansion zipper 476 to maintain the end of the expansion zipper in an engaged configuration. Opposing rails 510 may be formed as part of the joining member 454, the rails 510 extending away from the central extension 502 and extending along opposing sides or the expansion zipper 476. The opposing rails 510 may extend approximately 4 to 6 cms along each side of the expansion zipper 476, and are bonded with the outer surface 484 of the zipper tapes 466, 468. The opposing rails 510 extend at an angle relative to the central extension 502 when the expansion zipper 476 is open and the gusset 464 at least partially expanded. The opposing rails 510 provide an outwardly directed lateral force on each side of the expansion zipper 476 to aid in the initial engagement of the slider with the expansion zipper when closing the expansion zipper to collapse the gusset 464. Slits 514, shown as triangular regions on either side of the terminal end 506 of the expansion zipper 476 are formed along a short length (for example approximately 3 to 5 cm) of each modular zipper member 460, 462. The laterally spaced slits 514 allow the zipper teeth on each side of the expansion zipper to move outwardly to expand the gusset while the terminal end of the expansion zipper 506 remains engaged. The gusset 464 is exposed through the slits 514, which are triangular in shape when the gusset 464 is expanded.

Figure 8A:
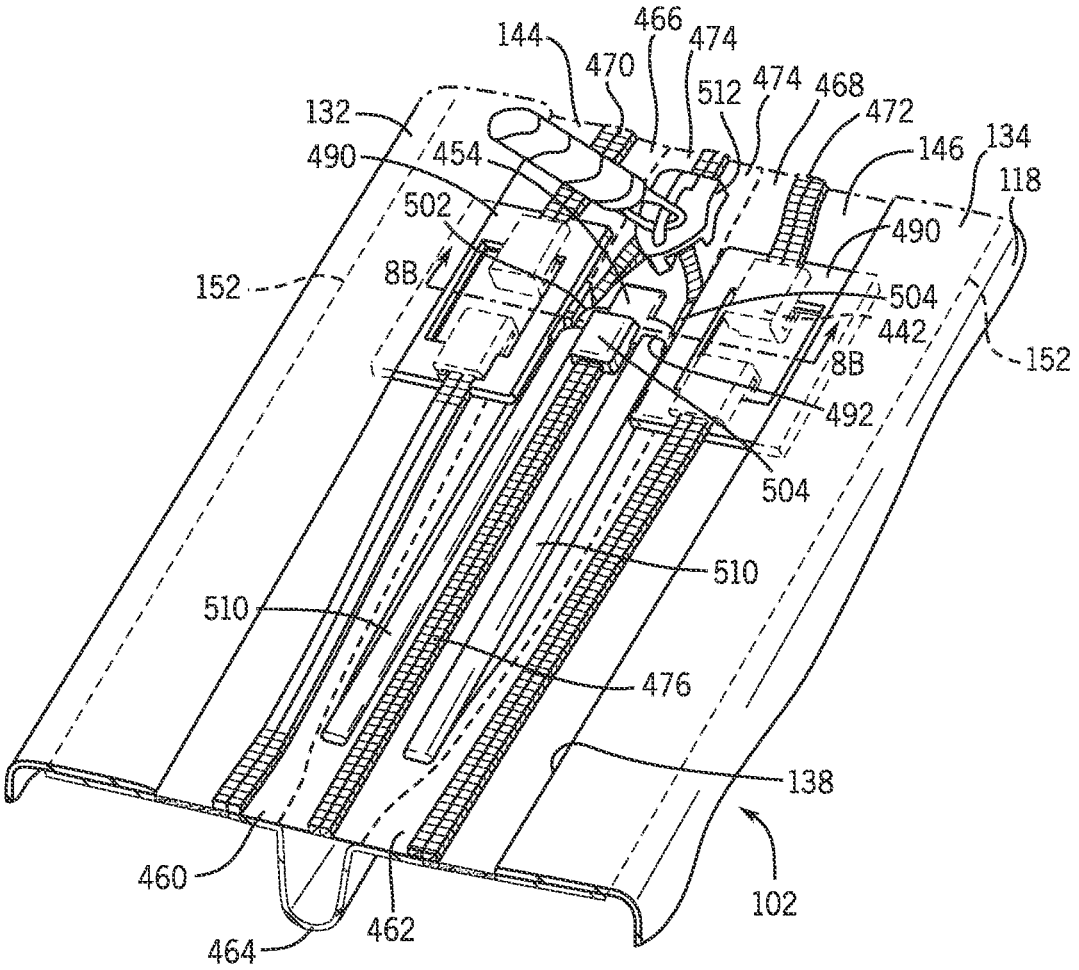
FIG. 8A is an enlarged perspective view of a modular expansion zipper assembly in the stowed configuration.
Figure 8B:
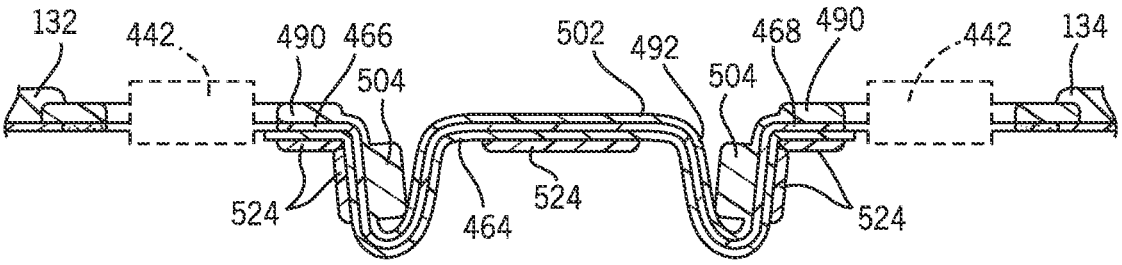
FIG. 8B is a section taken along line 8B-8B of FIG. 8A

FIG. 8*a* shows the expansion zipper 476 in the unexpanded position with the gusset 464 collapsed in a stowed configuration. In the unexpanded configuration, the joining member 454 shortens in length as the expansion zipper 476 is closed. To shorten in length, the joining member 454 may fold in an accordion-like manner, such as is shown in FIG. 8*b*, to accommodate the reduction of the lateral distance between the zipper teeth of the expansion zipper 476. In one example, the middle portion 492 may fold in an accordion-line manner. In one example, the central extension 502 of the middle portion 492 bends or creases along its length in all or some of the spaces between the protrusions 504. The joining member 454, and for example the middle portion 492 (and central extension 502), may be resiliently bendable such that upon expansion of the gusset, the central extension 502 of the middle portion 492 unfolds to extend and substantially its full width (see FIG. 7).

FIG. 9 shows the modular expansion zipper assembly 240 from the side of the gusset 464 with the expansion zipper 476 in the open and expanded configuration. The luggage shells are not shown in this view for clarity purposes. The joining member 454 may include an injection molded lower portion 522 that is applied to the expansion zipper assembly 240 on the lower surface 520 of the gusset 464. The lower portion 522 of the joining member 454 on this lower surface 520 may be formed in discrete sections 524 and extend across the gap 482 to engage both opposing ends 450, 452. The lower portion 522 of the joining member 454, for instance the discrete sections 524, may be separate from the joining member 454 applied to the top surface of the expansion zipper assembly 240, such as by being formed in a separate molding step, or may be connected with the joining member 454 such as being formed in the same molding step. The discrete sections 524 may also extend across the width of the gusset in general alignment with the middle portion 492 of the joining member 454. Referring back to FIG. 8*b*, the gaps 526 between the discrete sections 524 may fold or crease to allow the gusset to fold and allow the expansion zipper 476 to adapt the closed and unexpanded configuration. Alternatively, the lower portion 522 of the joining member 454 may be continuous across the gusset 464 and generally aligned with the gap 482, with the lower portion 522 having thinner and thicker cross sections to allow the lower portion to fold up when the gusset 464 is in the stowed position.

Referring to FIGS. 10A, 10B, 10C, and 10D, where the zip members 144, 146 include zipper teeth made of zipper coils, the assembly of the modular expansion zipper assembly 240 may ensure the appropriate orientation of the coil teeth orientation for desired zipper functioning. It may also allow for the appropriate number of teeth on the associated zippers so that the resulting luggage case 102 is not likely to be malformed, as noted above.

The structure of the example described here is similar to or the same as that shown in FIGS. 7-9, with the same structural labels and reference numbers, except where indicated. In this example, the zip members described include zipper teeth made of coils. Zipper structures with coiled zipper teeth generally are matched to pair left-hand coiled zipper teeth with right-hand coiled zipper teeth because left hand coil teeth only mate with right hand coil teeth, and vice versa. The shells 116, 118 of the luggage case 102 are not shown for clarity purposes.

Figure 10A:
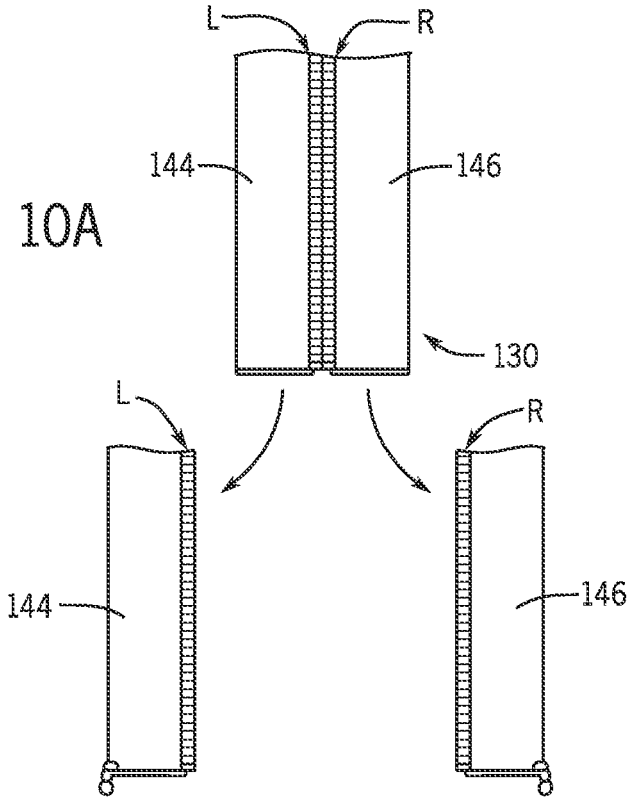
FIG. 10A shows a zipper separated into its constituent zipper members.

As shown schematically in FIG. 10A, the primary zipper assembly 130 includes the first primary zip member 144 and second primary zip member 146. When the cut to a length, and the opposing ends attached, the primary zipper assembly forms a matched zipper loop 380, including the first 381 and second 383 primary zipper loops. The first and second primary zipper loops 381, 383 are in-mould-bonded to, respectively, the left shell 116 and the right shell 118 as described herein. In one example this may be done in a manner consistent with that described with respect to FIGS. 5-6. Having coiled zipper teeth, the first primary zip member 144 (and first primary zipper loop 381) may have left-hand coil teeth L, and the second primary zip member 146 (and second primary zipper loop 383) may have right-hand coil teeth R such that they may engage when the primary zipper assembly 130 is closed.

Figure 10B:
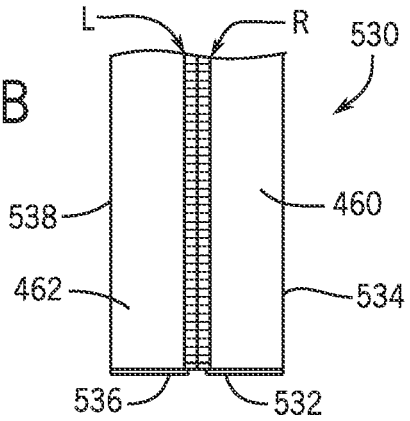
FIG. 10B shows a zipper similar to that shown in FIG. 10A.

The modular expansion zipper 240 assembly mates between the first primary zip member 144 on the first (left) shell 116 that has left-hand coiled teeth, and the second primary zip member 146 on the second (right) shell 118 that has right-hand coiled teeth, for example to convert a non-expanding luggage case into an expandable luggage case. To properly mate between the first shell 116 and second shell 118, the modular expansion zipper assembly 240 may be assembled to have right-hand zipper teeth R along the first outer edge 470 (left side, see FIG. 7) and left-hand zipper teeth L along its opposing second outer edge 472 (right side, see FIG. 7). This is accomplished, as shown in FIG. 10B, by starting with a matched zipper 530 including the first modular zipper member 460 with right-hand coil teeth R on edge 532 and no zipper teeth formed along edge 534, and the second modular zipper member 462 with left hand coil teeth L formed along edge 536, and no zipper teeth formed along edge 538. The matched zipper 530 is then cut to length to have the same or similar number of teeth between the first modular zipper member 460 and the second modular zipper member 462. This number of zipper teeth and resulting length is selected to match the number of teeth and length of the first primary and second primary zipper members 144, 146.

Figure 10C:
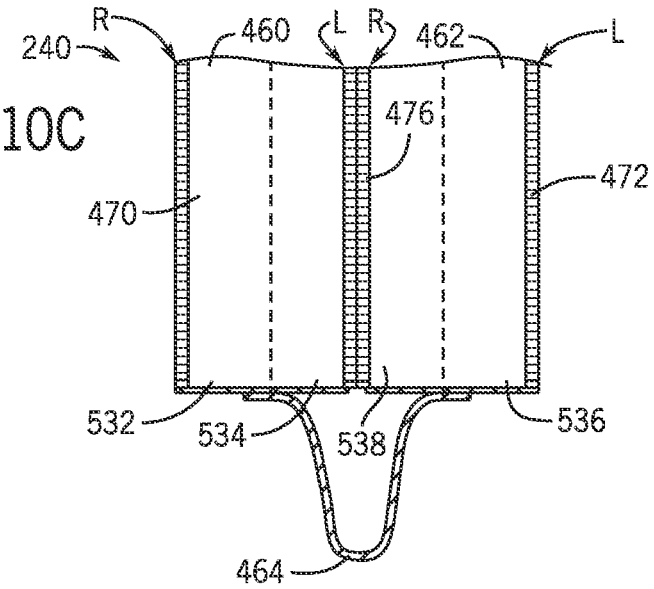
FIG. 10C shows the zipper members of FIG. 10B combined together with a gusset to form a modular zipper assembly.
Figure 10D:
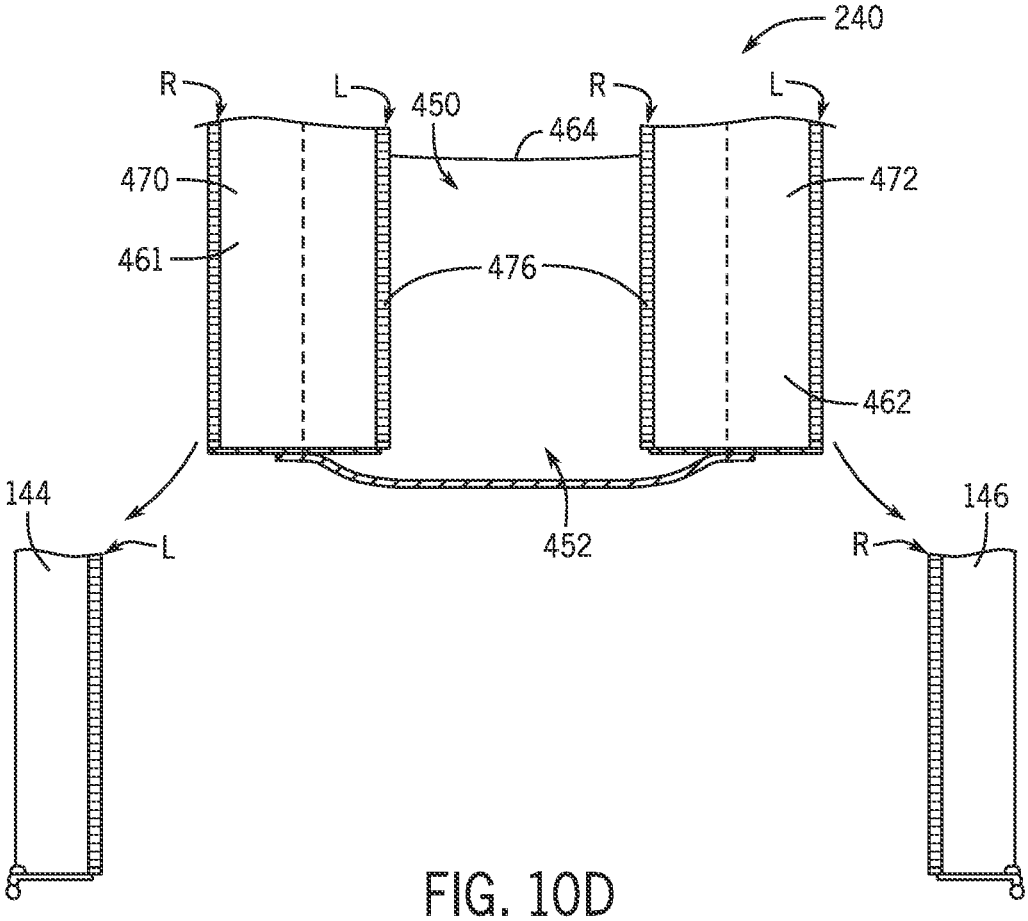
FIG. 10D shows the modular zipper assembly of FIG. 10C mounted with the zipper members of FIG. 10A.

The first and second modular zipper members 460, 462 are then separated and swapped side for side, as is shown in FIG. 10C, so that edge 534 of modular tape member 460 is placed adjacent to edge 538 of modular tape member 462. This re-orientation positions edge 532 having right-hand coil teeth R along the first outer edge 470 (left side, see FIG. 7) and edge 536 having left-hand coil teeth L along its opposing second outer edge 472 (right side, see FIG. 7). Matched coil teeth forming the expansion zipper 476 are then formed on edges 534 (left-hand coil teeth L) and 538 (right-hand coil teeth R) to releasably secure the edges together. Opposing edge portions of the gusset 464 may be attached to each of the respective first 460 and second 462 modular zipper tapes by stitching. This forms the modular expansion zipper assembly 240. A slider may optionally be engaged with the expansion zipper 476 to allow it to open and close along its length. The modular expansion zipper assembly, with the expansion zipper in a closed configuration, may then be formed into a loop with its opposing ends 450, 452 attached together, with the loop matching the number of teeth and length of both the first 144 primary and second 146 primary zip members. The opposing ends 450, 452 of the zipper loop may be connected together in an abutted configuration, an overlapping configuration, or with a slight gap between the opposing ends. The application of an overmolded joining member 454 on the exposed side or on the interior side of the gusset 464 of the opposing ends 450, 452 may be used, such as the example described herein with respect to FIGS. 6 to 8, and more specifically with respect to FIGS. 7, 8, and 9.

Zipper end clips 442, such as in FIGS. 6 and 7 are engaged with the terminal ends of zipper assemblies. End clips block the movement of the slider beyond the end of the zipper assembly, as well as maintain engagement between the engaged zipper teeth to help keep them from separating. Zipper end clips are often separate from one another when mounted on their respective terminal zipper ends. Typically one end clip is mounted on both of the opposing ends of a zipper assembly, and a gap is formed between the adjacent end clips. The gap may allow access into the internal cavity of the luggage case, and is generally an unsightly feature of a luggage case. Many times the end clips and gap are covered by an aesthetic feature, such as a decorative panel, to cover over the gap.

The example in FIGS. 11A, 11B, 11C, 11D, 11E, and 11F, shows a zipper end clip 600 on one terminal end 602 of a zipper assembly 604 that is engaged with the zipper end clip 606 on the other terminal end 608 of the zipper assembly 604. This engagement of end clips 600 and 606 may aid in covering or filling in a hole, gap, or aperture 610 between the terminal ends of the zipper assembly, as well as strengthening and stabilizing the opposing ends of the zipper assembly. The hole, gap, or aperture 610 may be similar to or the same as the cut-out area 398 shown in FIGS. 4 and 5. Additionally and optionally, connected zipper end clips 600, 606 may provide a finished appearance at the terminal ends of the zipper assembly 604, which typically appear utilitarian and may be covered by an aesthetic fabric component to provide a finished look. With the engaged zipper end clips 600, 606 filling in the gap 610, a cover patch may not be needed. In one example, however, an aesthetic fabric component may still be applied for aesthetic or other purposes.

Figure 11A:
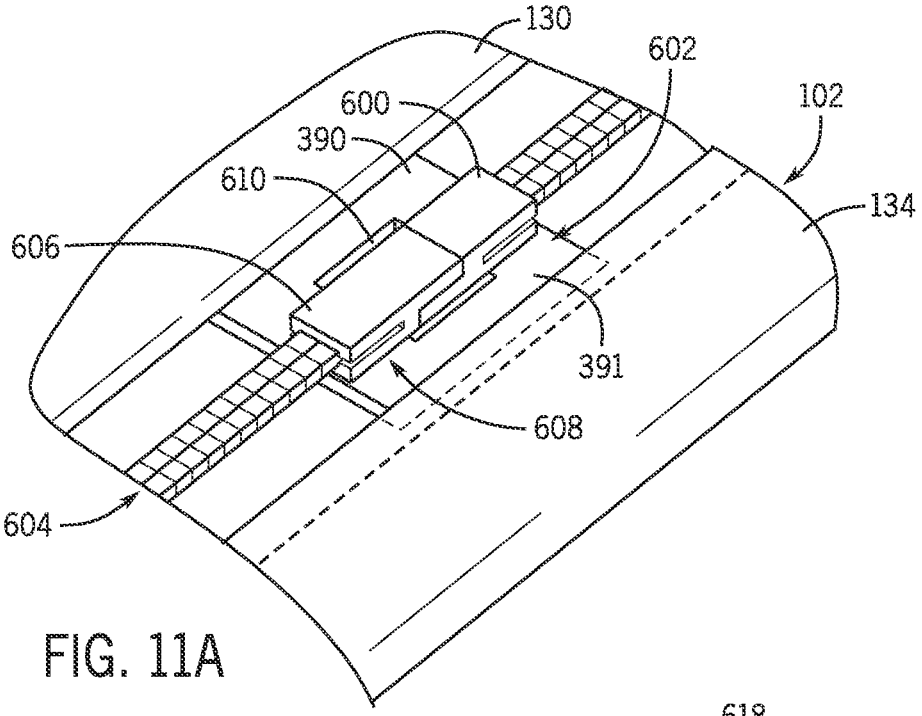
FIG. 11A is an enlarged perspective view of the terminal end of a zipper assembly with engaged clip ends mounted on the terminal ends of the zipper
Figure 11C:
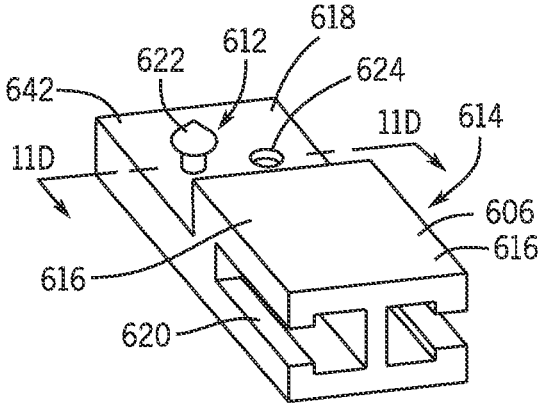
FIG. 11C is a perspective view of a clip end.
Figure 11B:
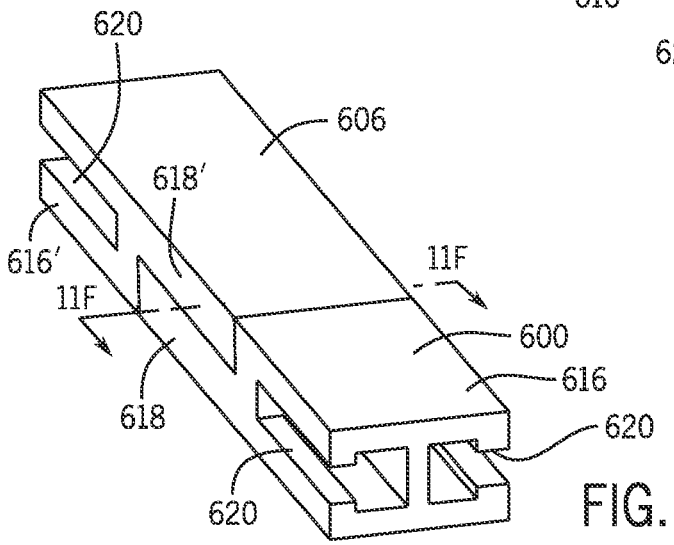
FIG. 11B is a perspective view of engaged clip ends connected together.

The zipper end clips 600, 606 engage one another by an interlocking feature 612, and in one example, such as shown in FIGS. 11A and 11B, may form a unitary body, which in one example has a parallel-piped shape (e.g. a rectangular block) when joined. The engaged end clips 600, 606 may create other shapes as well. In one example, each end clip may be shaped such that it can be re-oriented to engage another end clip having the same shape and be connected together by the interlocking interface.

In one example, as shown in FIG. 11B, end clips 600 and 606 have similar or identical interlocking interface in common with one another that allow them to be connected together. In one example the shape of each end clip 600, 606 may not be similar to each other but for the interlocking feature 612. In another example, as described herein, each end clip 600, 606 may have a similar or identical overall shape and function to one another.

As shown in FIG. 11B and FIG. 11C, an end clip 600 may include a main body 614 having a first portion 616 and a second portion 618. The first portion 614 may engage the terminal end 602 of the zipper assembly 604, and may include adjacent tracks 620 each for receiving a respective length of zipper teeth. The second portion 618 may extend from the first portion 616, and may define the interlocking feature 612. A first end clip 600 and a second end clip 606 may be oriented with respect to each other such that the second portions 618, 618' are positioned adjacent one another, with the interlocking features 612, 612' of each end clip 600, 606 engaging together to attach the first and second end clips together. In one example the second portions 618, 618' may nest together and create a combined shape between the two end clips that appears integral and/or unitary (such as in FIG. 11B). The interlocking features 612, 612' may be releasable from one another to allow the two end clips 600, 606 to separate, or the interlocking features may be relatively permanently connected to resist easy disengagement from one another.

Figure 11D:
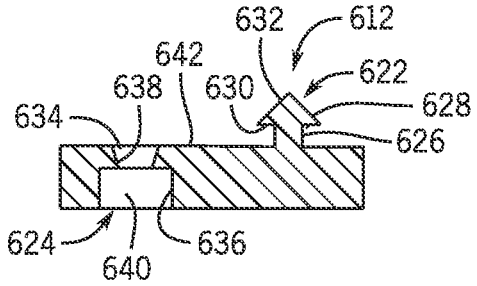
FIG. 11D is a section view taken along line 11D-11D of FIG. 11C.

In one example, such as that shown in FIGS. 11C, 11D, 11E, and 11F, the interlocking feature 612 formed on the end clip 600 may in include more than one interlocking feature, such as a protrusion 622 and an aperture 624. The protrusion 622 may have a columnar shaped lower portion 626 with an enlarged tip portion 628. In one example, such as shown in FIG. 11D, the enlarged tip portion 628 includes a base 630 that extends outwardly from the columnar lower portion 626, and a terminal end 632 that has a shape smaller than the width of the base 630. In one example, the tip portion 628 may cone shaped. The aperture 624 may have a first region 634 with a first diameter and a second region 636 with a second diameter, the first diameter being smaller than the second diameter. The first region 634 may form a retaining collar 638. The retaining collar 638 may have a sloped wall 644. The second region 636 may form a cavity 640. The aperture 624 may or may not extend all the way through the second portion. The protrusion 622 and aperture 624 are positioned symmetrically on the second portion 618 of the main body 614 so that when the second portion 618 of one end clip 600 is oriented to engage the second portion 618' of another end clip 606, the interlocking features 612, 612' are aligned to engage.

More particularly, the protrusion 622 and aperture 624 on one second portion 618 is aligned with the aperture 624' and protrusion 622', respectively, on the other second portion 618'. With symmetrically positioned interlocking features 612, 612', one shape of end clip may be used to engage two end clips together. The symmetry between the interlocking features 112, 112' on each end clip 600, 606, allow the end clips to be re-oriented with respect to each other so the interlocking features engage. Alternatively, interlocking features having other designs may be used, such as for instance a protrusion on one end clip and an aperture on the other end clip, which may engage to secure the end clips together. This would require making two types of end clips, as opposed to a single end clip that may engage with another end clip having an identical interlocking feature.

Figure 11E:
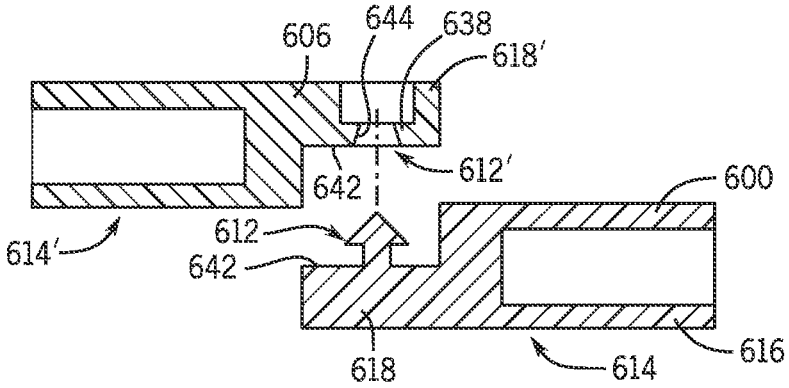
FIG. 11E is representative section view of one clip end engaging with another clip end.
Figure 11F:
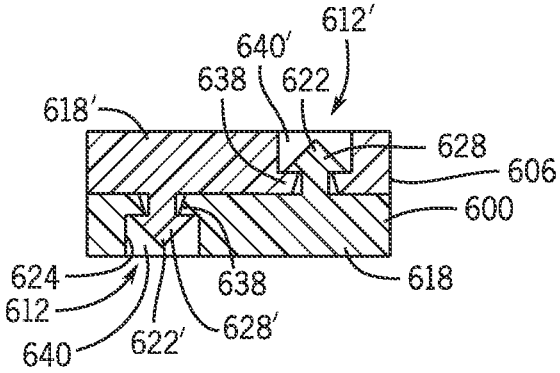
FIG. 11F is a section view taken along line 11F-11F of FIG. 11B.

In one example, such as that shown in FIGS. 11E and 11F, the second portions 618, 618' of each of the two end clips 600, 606 are oriented such that the protrusion 622 of the first end clip 600 is aligned with the aperture 624' of the second end clip 606. Similarly, the protrusion 622' of the second end clip 606 is aligned with the aperture 624 of the first end clip 600. The interlocking features 612, 612' engage by moving the second portions 618, 618' towards one another such that the enlarged tips 628, 628' of the protrusions 622, 622' pass through the retaining collar 638,638' and are received in the cavity 640, 640', as shown in FIG. 11F. With the interlocking features 612, 612' engaged between the two clips, the second portions 618, 618' are nested together and the combined end clips 600, 606 are engaged together.

In the example shown here, the first portion 616, may have the shape of a rectangular block, and may have a height, width and length. The second portion 618, for example in the shape of a rectangular block, may also have a height, width and length. The height of the second portion 618 may be less than the height of the first portion 616, and the width and length may be similar to or the same as those dimension of the first portion 616. In one example the height of the second portion 618 is approximately ½ of the height of the first portion 614. The interlocking feature 612 may be formed on the second portion 618. In one example, and as shown in FIGS. 11D, 11E, and 11F, the protrusion 622 may extend from the recessed surface 642 of the second portion 618, and the first region of the aperture 624 may be adjacent the recessed surface 642 of the second portion, with the cavity 640 adjacent the opposite face from the recessed surface 642.

The zipper end clip 600 may be made of a deformable material to allow the first portion 614 to be deformed to clamp the portion of zipper teeth in the respective track 620 to retain the end clip 600 on the terminal end 602, 608 of the zipper assembly 604.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

It is possible to express at least some of the novel and inventive features of the present disclosure by reference to one or more of the following numbered clauses.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage case including a zipper loop mounted thereon comprising:

a first zip member having an elongated first tape member with first zipper teeth extending along an edge, the first zip member having first and second opposing ends, the first zip member attached along a first rim portion of a first shell;

a second zip member having an elongated second tape member with second zipper teeth extending along an edge, the second zip member having third and fourth opposing ends, the second zip member attached along a second rim portion of a second shell, and wherein:

the first zip member and the second zip member include substantially the same number of zipper teeth;

the first zip member and the second zip member are attached together by engaging the first and second zipper teeth, with the first opposing end laterally adjacent the third opposing end, and the second opposing end laterally adjacent the fourth opposing end;

the first opposing end attached to the second opposing end by a first joining member; and the third opposing end attached to the fourth opposing end by a second joining member, wherein:

a cut-out region is formed at each interior corner of the first and second tape members; and each of the first and second joining members extend around the respective cut-out region to define an opening formed between the first and second zip members.

2. The luggage case of claim 1, wherein:

The first joining member is injection molded onto the first opposing end and the second opposing end; and The second joining member is injection molded onto the third opposing end and the fourth opposing end.

3. The luggage case of claim 2, wherein:

the first joining member is overmolded to one of the opposing surfaces of the opposing ends of the first tape member; and the second joining member is overmolded to one of the opposing surfaces of the opposing ends of the second tape member.

4. The luggage case of claim 1, wherein:

the first joining member forms at least one beam extending from the first zipper teeth, and the second joining member forms at least one beam extending from the second zipper teeth; or the first joining member forms one beam at each of the opposing ends, and the second joining member forms one beam at each of the opposing ends.

5. The luggage case of claim 4, further comprising:

a first end clip for securing the at least one first beam and the at least one second beam, the end clip including a first end portion for receiving the at least one first beam and the at least one second beam; and a second portion extending from the first portion and defining an interlocking feature.

6. The luggage case of claim 5, wherein the interlocking feature includes a first feature and a second feature symmetrically positioned about a long axis of the second end portion, and/or the first feature is a protrusion, and the second feature is an aperture.

7. The luggage case of claim 1, wherein:

the first joining member includes at least one end clip engaging the first zipper teeth and/or the second zipper teeth.

8. The luggage case of claim 1, further comprising:

a modular expansion zipper assembly comprising:

a first and second zip tape members, each including a tape defining zipper teeth extending along opposing outer and inner edges;

a flexible gusset attached between the first and second zip tape members;

an expansion zip formed by releasably engaging the zipper teeth on the inner edges, the expansion zip converting between a unexpanded position when the zipper teeth are engaged, and an expanded position when the zipper teeth are disengaged; and a first outer zipper edge defined by the zipper teeth on the outer edge of the first zip tape member;

a second outer zipper edge defined by the zipper teeth on the outer edge of the second zip tape member; and the first outer zipper edge releasably engaging the first zip member; and the second outer zipper edge releasably engaging the second zip member.

9. The luggage case of claim 8, wherein:

the joining member may include a middle portion positioned along the opposing ends of the first and second zip tape members, and at least one protrusion extending away from the middle portion;

the at least one protrusion forming an end clip on one of the first outer zipper edge, second outer zip edge, or the expansion zip.

10. The luggage case of claim 8, wherein:

the joining member is positioned at least partially on a lower surface of the gusset.

11. The luggage case of claim 8, wherein:

the joining member includes a first rail formed on the first zip tape member and a second rail formed on the second zip tape member, each rail extending from the middle portion at an angle towards the outer edge of the first and second zip tape member, respectively, when the expansion zip is in the expanded position.

12. The luggage case of claim 8, wherein:

the middle portion extends when in the expanded position, and the middle portion folds when in the stowed position.

13. The luggage case as defined by claim 12, further comprising:

a second end clip for securing the beams at the opposing ends of the first and second zipper teeth respectively, the second clip having a first portion for receiving the beams, and a second end portion defining a second interlocking feature; and wherein the interlocking feature of the first end clip engages the second interlocking feature of the second end clip to secure the two end clips together.

14. The luggage case of claim 13, wherein:

the second interlocking feature includes a first feature and a second feature; and the first feature on the first end clip engages the second feature on the second end clip, and the second feature on the first end clip engages the first feature on the second end clip to secure the two end clips together.

* * * * *